US006745873B1

(12) United States Patent
Chen

(10) Patent No.: US 6,745,873 B1
(45) Date of Patent: Jun. 8, 2004

(54) BRAKING DEVICE FOR AN EXERCISING CYCLE

(76) Inventor: Hsi-Yuan Shawn Chen, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/356,761

(22) Filed: Jan. 29, 2003

(51) Int. Cl.[7] ..... A63B 7/02
(52) U.S. Cl. ..... 188/24.11; 482/114
(58) Field of Search ..... 188/24.11, 26, 188/67, 25; 482/64, 114, 57, 115, 127; 16/38

(56) References Cited

U.S. PATENT DOCUMENTS 5,727,285 A * 3/1998 Goman ..... 16/38
6,241,642 B1 * 6/2001 Slenker ..... 482/114
6,491,606 B1 * 12/2002 Swift ..... 482/57

* cited by examiner

*Primary Examiner*—Christopher P. Schwartz
*Assistant Examiner*—Melanie Torres

(57) ABSTRACT

A braking device for an exercising cycle includes a main body, a mounting member, and a plurality of braking mechanisms. Each of the braking mechanisms includes a braking member, a threaded block, and an elastic member. Thus, the braking device can achieve the braking effect without having to provide the brake pad, thereby saving consumption of material. In addition, the braking effect is provided by the multiple braking rods, so that the applied force can be evenly distributed, thereby increasing the lifetime of the braking device. Further, the threaded block can be rotated to adjust the magnitude of the braking force, thereby achieving the exercising effect efficiently.

12 Claims, 7 Drawing Sheets

BRAKING DEVICE FOR AN EXERCISING CYCLE

BACKGROUND OF THE INVENTION

1. Field of the Invention

The present invention relates to a braking device for an exercising cycle, and more particularly to a braking device for an exercising cycle, wherein the braking device can achieve the braking effect without having to provide the brake pad, thereby saving consumption of material.

2. Description of the Related Art

An exercising cycle disclosed in U.S. Pat. No. 5,961,424 comprising a chain for driving the front wheel to rotate by stepping the pedals, and a braking device mounted in the front wheel to reduce the speed of the front wheel or stop rotation of the front wheel. The braking device includes a brake pad to produce friction so as to reduce the speed of the front wheel or stop rotation of the front wheel.

However, the braking device of the exercising cycle has the following disadvantages.

1. The brake pad easily produces heat due to friction, so that the brake pad is easily worn out and needs to be replaced frequently, thereby decreasing the lifetime of the brake pad.
2. The brake pad is mounted in the braking device, so that the user needs to detach the whole braking device to replace or adjust the brake pad, thereby causing inconvenience in maintenance and replacement.

SUMMARY OF THE INVENTION

The present invention is to mitigate and/or obviate the disadvantage of the conventional braking device of the exercising cycle.

The primary objective of the present invention is to provide a braking device for an exercising cycle, wherein the braking device can achieve the braking effect without having to provide the brake pad, thereby saving consumption of material.

Another objective of the present invention is to provide a braking device for an exercising cycle, wherein the braking effect is provided by the multiple braking rods, so that the applied force can be evenly distributed, thereby increasing the lifetime of the braking device.

A further objective of the present invention is to provide a braking device for an exercising cycle, wherein the threaded block can be rotated to adjust the pressing force of the elastic member on the braking rod so as to adjust the magnitude of the braking force, thereby achieving the exercising effect efficiently.

A further objective of the present invention is to provide a braking device for an exercising cycle, wherein the threaded block can be detached from each of the slots of the main body easily and conveniently so as to rapidly replace the braking rod when being worn out, thereby facilitating maintenance of the braking device.

In accordance with the present invention, there is provided a braking device for an exercising cycle, comprising a main body, a mounting member, and a plurality of braking mechanisms, wherein:

the main body has an inner wall formed with a hollow portion, the main body has a periphery formed with a plurality of slots, each of the slots of the main body has an inner end formed with an opening communicating with the hollow portion of the main body;

the mounting member is mounted in the hollow portion of the main body and has a periphery; and each of the braking mechanisms is mounted in a respective one of the slots of the main body, each of the braking mechanisms includes:

a braking member mounted in each of the slots of the main body and having a distal end protruding outward from the opening of each of the slots of the main body and extending into the hollow portion of the main body to urge the periphery of the mounting member;

a threaded block mounted in each of the slots of the main body; and an elastic member mounted in each of the slots of the main body and urged on the braking member and the threaded block.

Further benefits and advantages of the present invention will become apparent after a careful reading of the detailed description with appropriate reference to the accompanying drawings.

DETAILED DESCRIPTION OF THE INVENTION

Figure 1:
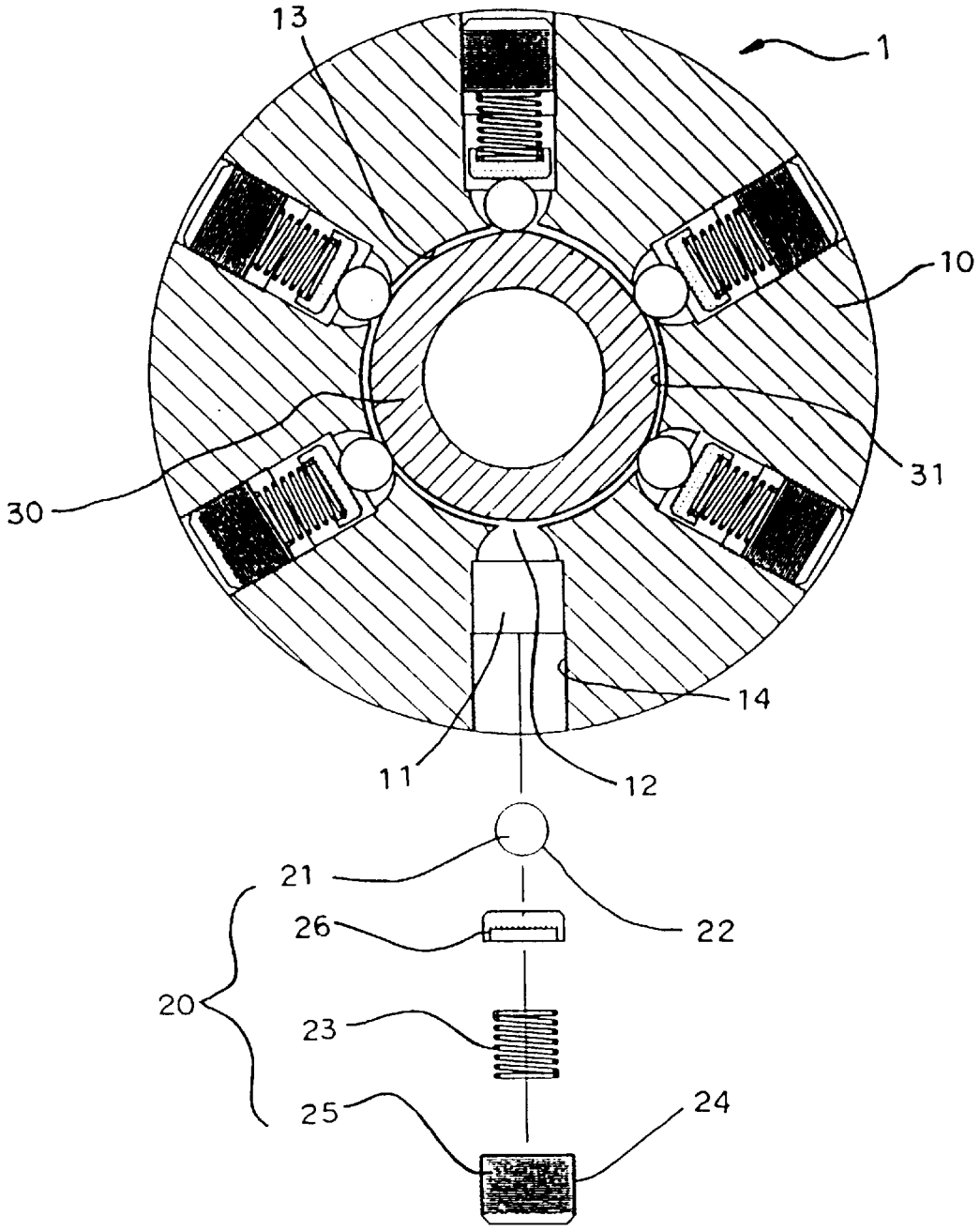
FIG. 1 is a plan cross-sectional exploded view of a braking device for an exercising cycle in accordance with the first embodiment of the present invention.

Referring to the drawings and initially to FIGS. 1–6, a braking device 1 for an exercising cycle in accordance with the first embodiment of the present invention comprises a main body 10, a plurality of braking mechanisms 20, and a mounting member 30.

The main body 10 has a periphery formed with a plurality of slots 11 which are equally spaced from each other. The main body 10 has an inner wall formed with a hollow portion 13. Each of the slots 11 of the main body 10 has an inner end formed with an opening 12 communicating with the hollow portion 13 of the main body 10. Preferably, the opening 12 of each of the slots 11 of the main body 10 has an arcuate shape. Each of the slots 11 of the main body 10 has a wall formed with an inner threaded portion 14.

Each of the braking mechanisms 20 is mounted in a respective one of the slots 11 of the main body 10. Each of the braking mechanisms 20 includes a braking rod 21, an urging plate 26, an elastic member 23, and a threaded block 25.

The braking rod 21 is mounted in each of the slots 11 of the main body 10. The braking rod 21 has an arcuate portion 22 protruding outward from the opening 12 of each of the slots 11 of the main body 10 and extending into the hollow portion 13 of the main body 10.

The urging plate 26 is mounted in each of the slots 11 of the main body 10 and urged on the braking rod 21.

The threaded block 25 is mounted in each of the slots 11 of the main body 10. The threaded block 25 has an outer threaded portion 24 screwed into the inner threaded portion 14 of each of the slots 11 of the main body 10.

The elastic member 23 is mounted in each of the slots 11 of the main body 10, and urged between the urging plate 26 and the threaded block 25.

The mounting member 30 is mounted in the hollow portion 13 of the main body 10, and has a periphery 31 urged on the arcuate portion 22 of the braking rod 21 of each of the braking mechanisms 20.

Figure 2:
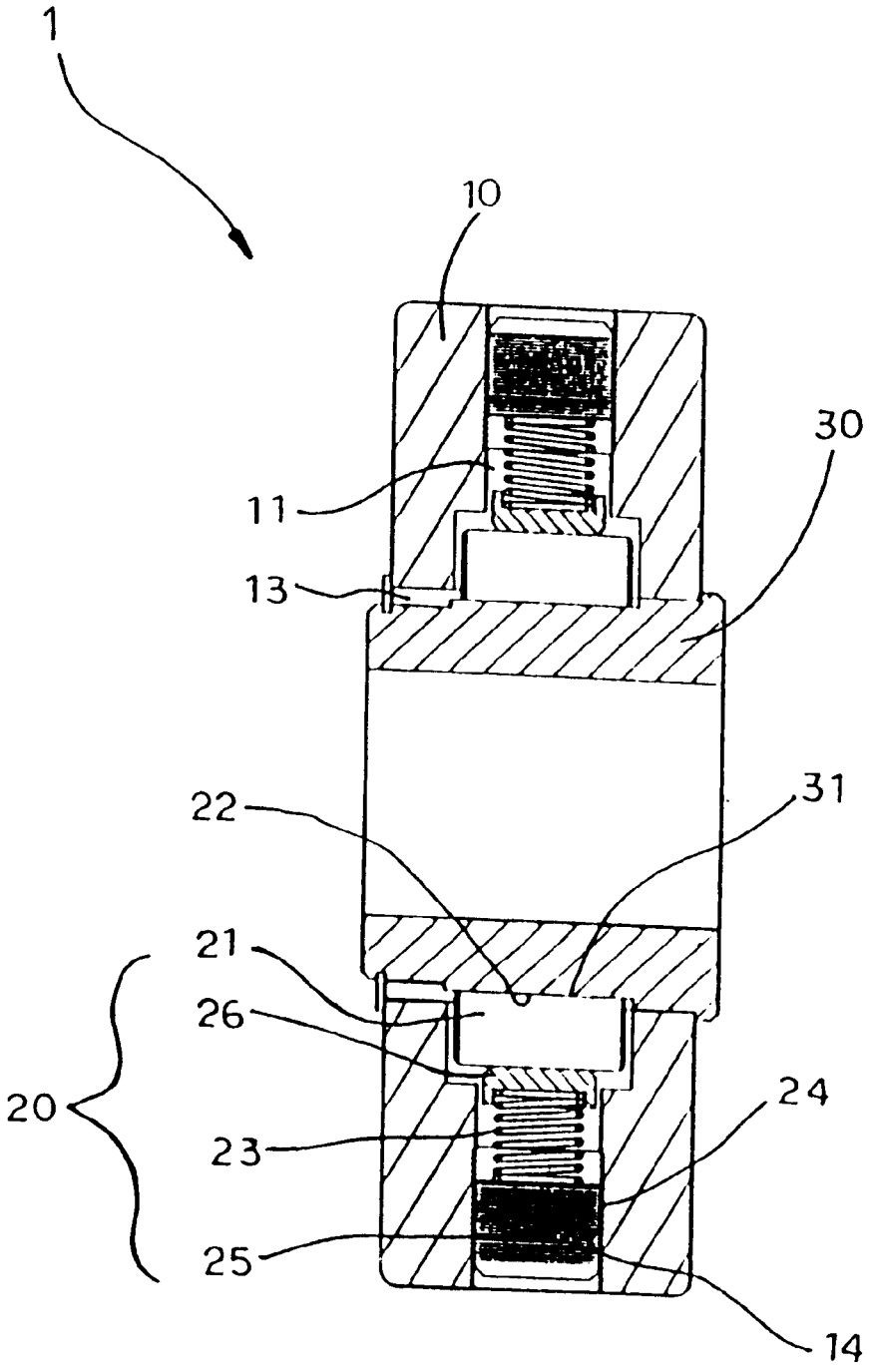
FIG. 2 is a plan cross-sectional assembly view of the braking device for an exercising cycle in accordance with the first embodiment of the present invention.
Figure 3:
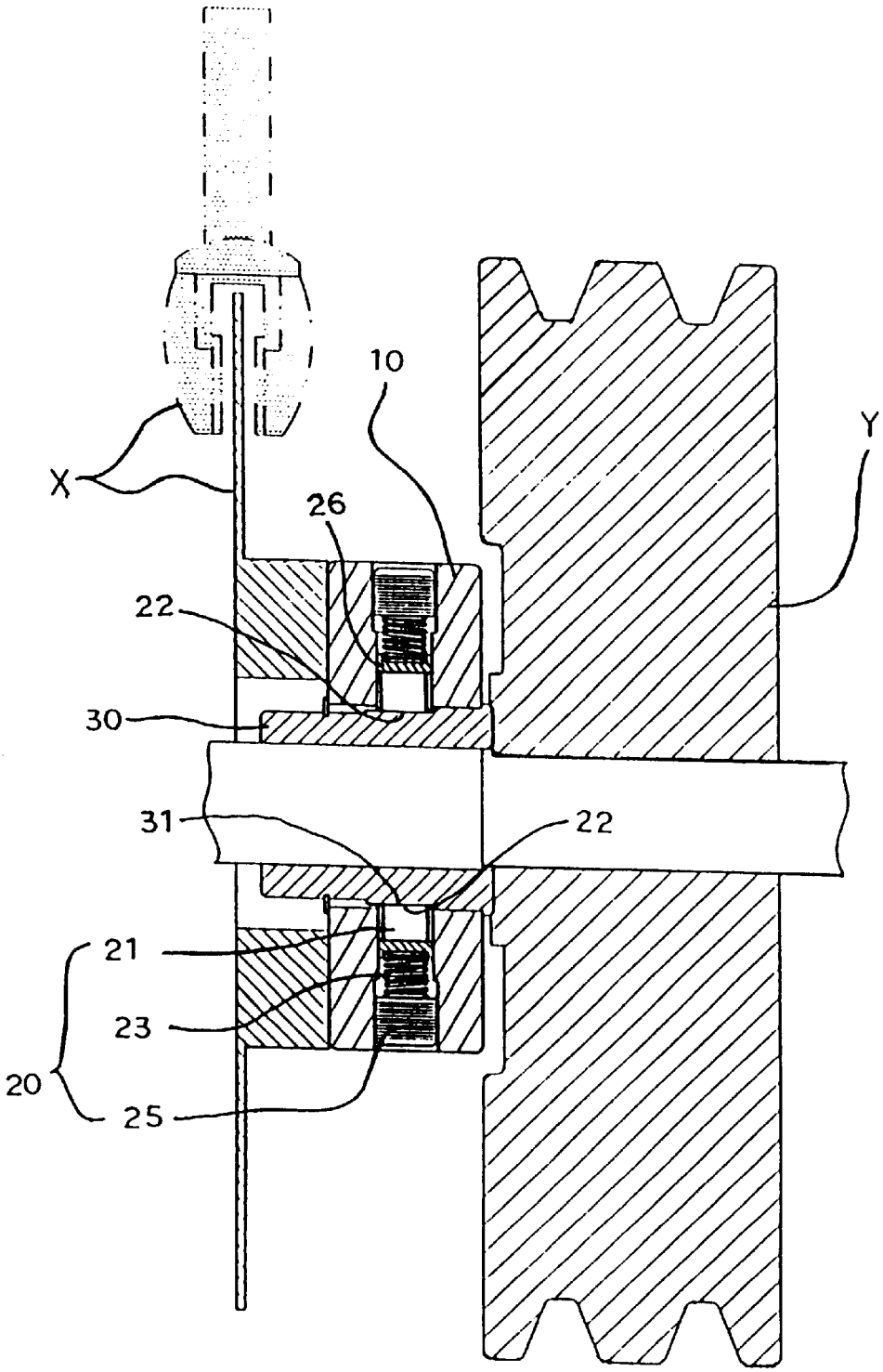
FIG. 3 is a plan cross-sectional assembly view showing usage of the braking device for an exercising cycle in accordance with the first embodiment of the present invention.
Figure 4:
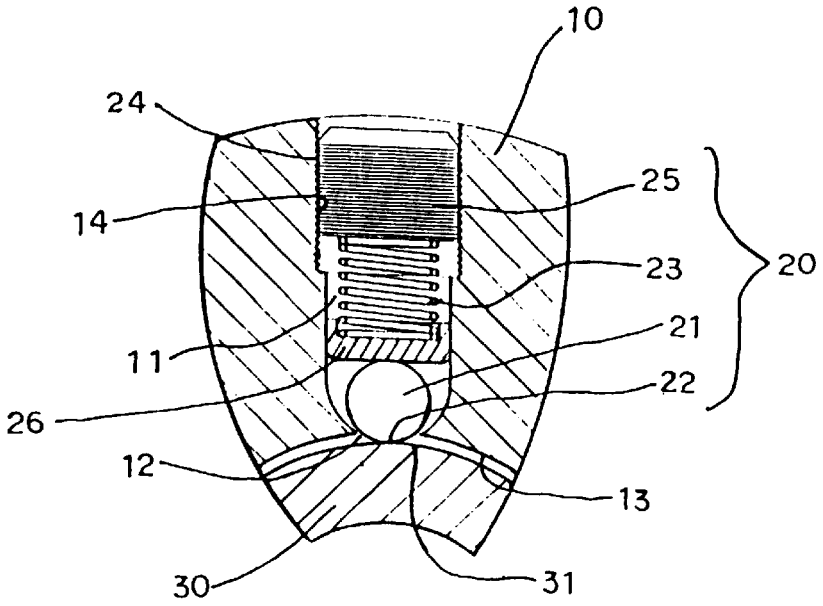
FIG. 4 is a partially enlarged view of the braking device for an exercising cycle as shown in FIG. 1.
Figure 5:
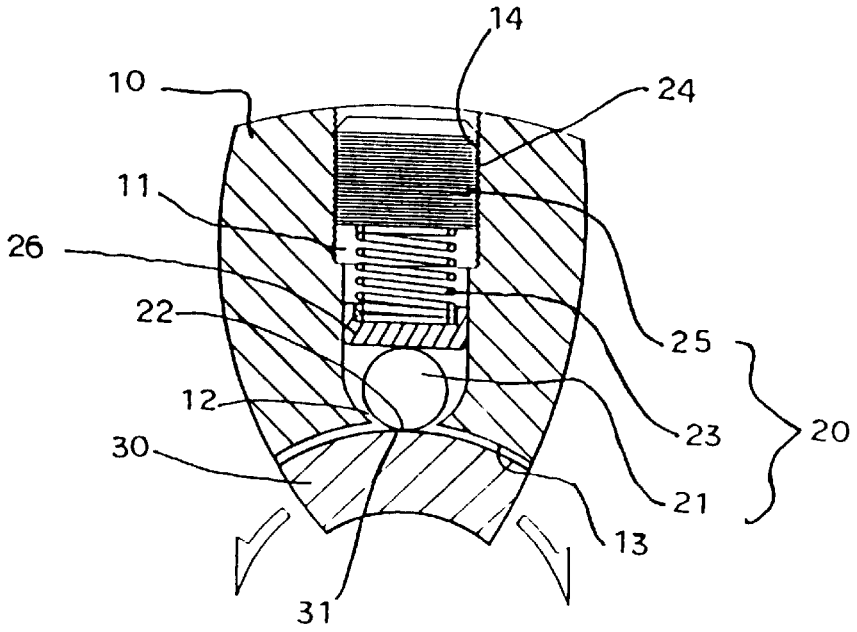
FIG. 5 is a partially enlarged operational view of the braking device for an exercising cycle as shown in FIG. 1.
Figure 6:
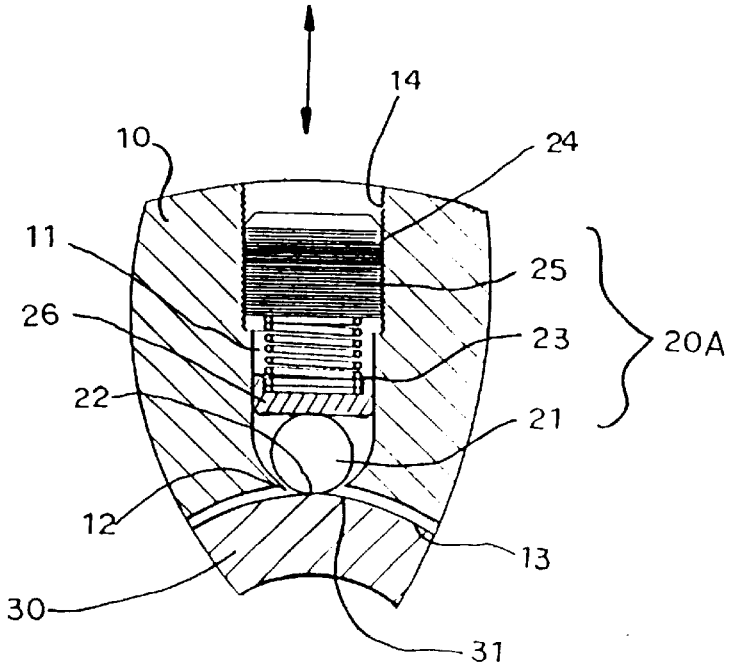
FIG. 6 is a partially enlarged operational view of the braking device for an exercising cycle as shown in FIG. 1.

In operation, referring to FIGS. 3–6 with reference to FIGS. 1 and 2, the main body 10 is fixed on a locking device X to function as a fixing member, and the mounting member 30 is fixed on a flywheel Y of the exercising cycle to function as a movable member as shown in FIG. 3. The elastic member 23 urged between the urging plate 26 and the threaded block 25 applies a pressing force on the urging plate 26 which presses the braking rod 21, so that the arcuate portion 22 of the braking rod 21 is pressed to protrude outward from the opening 12 of each of the slots 11 of the main body 10 and extend into the hollow portion 13 of the main body 10 to press the periphery 31 of the mounting member 30 as shown in FIG. 4, thereby providing a braking effect on the mounting member 30, so as to reduce the rotation speed of the flywheel Y or to stop movement of the flywheel Y gradually as shown in FIG. 5. The threaded block 25 can be rotated so as to adjust the pressing force of the elastic member 23 on the braking rod 21 so as to adjust the braking force of the braking rod 21 on the mounting member 30 as shown in FIG. 6.

Figure 9:
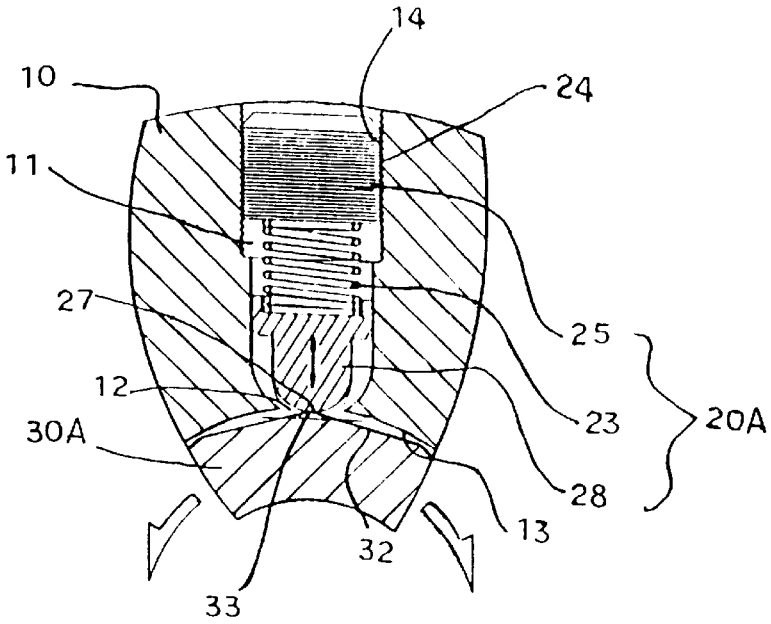
FIG. 9 is a partially enlarged operational view of the braking device for an exercising cycle as shown in FIG. 7.
Figure 7:
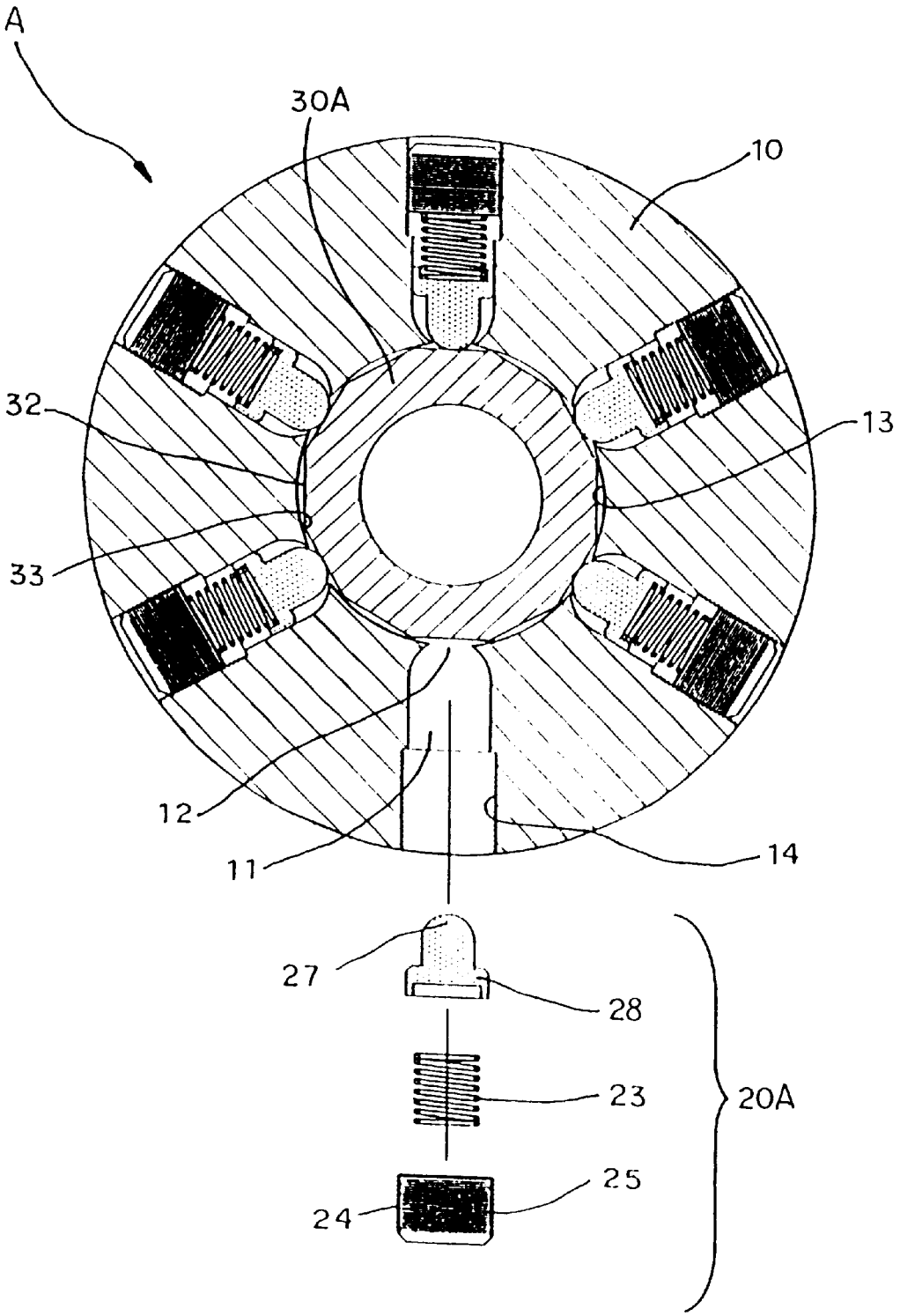
FIG. 7 is a plan cross-sectional exploded view of a braking device for an exercising cycle in accordance with the second embodiment of the present invention.
Figure 8:
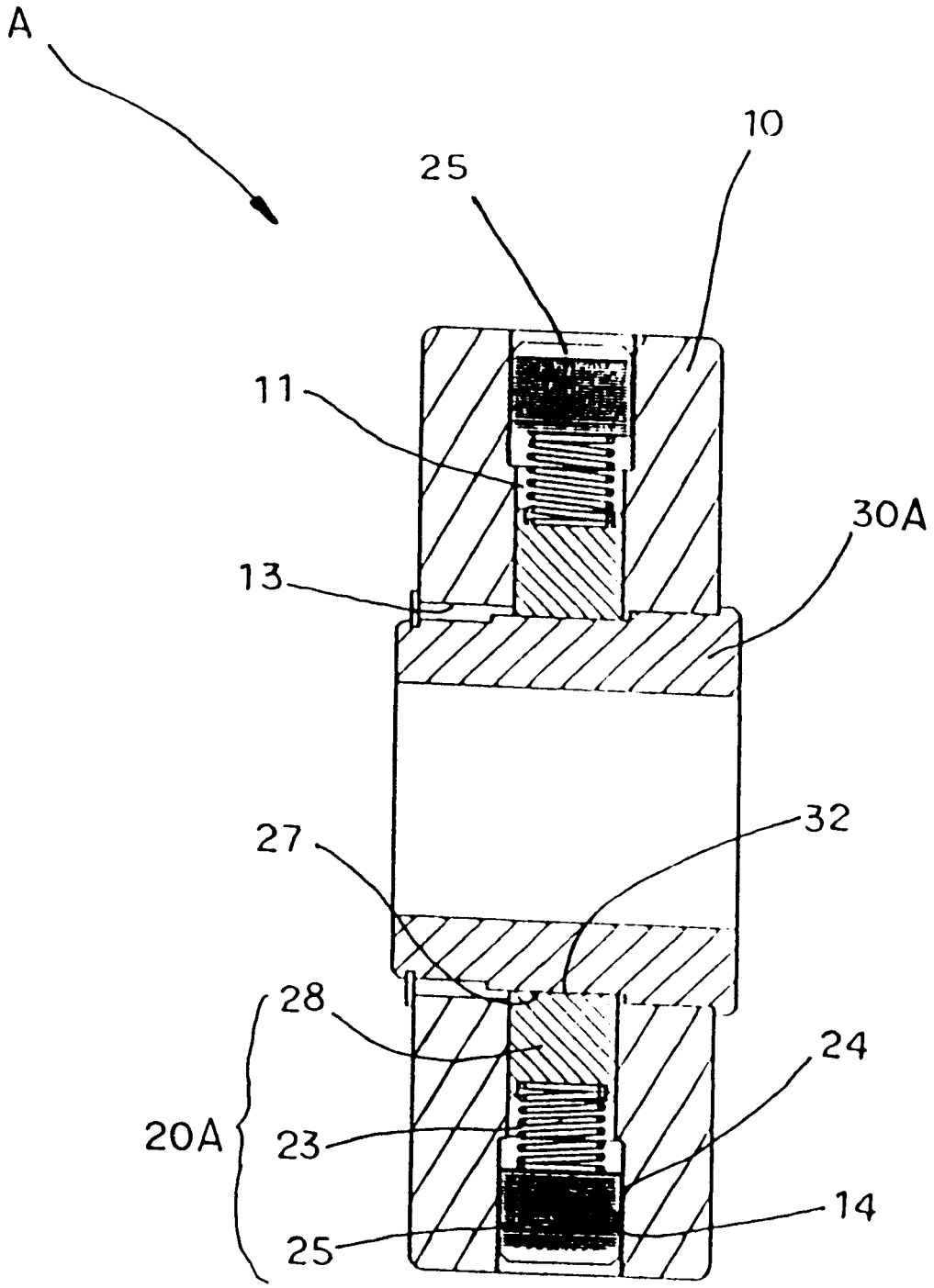
FIG. 8 is a plan cross-sectional assembly view of the braking device for an exercising cycle in accordance with the second embodiment of the present invention.

Referring to FIGS. 7–9, the braking device A for an exercising cycle in accordance with the second embodiment of the present invention is shown, wherein the urging plate 26 and the braking rod 21 are replaced by a braking block 28 of each of the braking mechanisms 20A. The braking block 28 is mounted in each of the slots 11 of the main body 10 and has an arcuate protruding portion 27 protruding outward from the opening 12 of each of the slots 11 of the main body 10 and extending into the hollow portion 13 of the main body 10. In addition, the mounting member 30A is mounted in the hollow portion 13 of the main body 10, and has a periphery formed with a plurality of flat sections 32 urged on the arcuate protruding portion 27 of the braking block 28 of each of the braking mechanisms 20A. The flat sections 32 of the mounting member 30A are equally spaced from each other. The periphery of the mounting member 30A is formed with a plurality of corners 33 each located between any two adjacent flat sections 32.

In such a manner, when the mounting member 30A is rotated, the arcuate protruding portion 27 of the braking block 28 of each of the braking mechanisms 20A is urged on the flat sections 32 (see FIG. 7) and the corners 33 (see FIG. 9) of the mounting member 30A successively, thereby providing a braking effect on the mounting member 30A, so as to reduce the rotation speed of the flywheel or to stop movement of the flywheel.

Accordingly, the braking device for an exercising cycle in accordance with the present invention has the following advantages.

The braking rod 21 (or the braking block 28) is pressed by the elastic force of the elastic member 23 to urge the periphery of the mounting member 30 (or the mounting member 30A), so as to achieve the braking effect, without having to provide the brake pad, thereby saving consumption of material.

In addition, the braking effect is provided by the multiple braking rods 21 (or the braking blocks 28), so that the applied force can be evenly distributed, thereby increasing the lifetime of the braking device.

Further, the threaded block 25 can be rotated to adjust the pressing force of the elastic member 23 on the braking rod 21 so as to adjust the magnitude of the braking force, thereby achieving the exercising effect efficiently.

Further, the threaded block 25 can be detached from each of the slots 11 of the main body 10 easily and conveniently so as to rapidly replace the braking rod 21 when being worn out, thereby facilitating maintenance of the braking device.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A braking device for an exercising cycle, comprising a main body, a mounting member, and a plurality of braking mechanisms, wherein:

the main body has an inner wall formed with a hollow portion, the main body has a periphery formed with a plurality of slots, each of the slots of the main body has an inner end formed with an opening communicating with the hollow portion of the main body;

the mounting member is mounted in the hollow portion of the main body and has a periphery; and each of the braking mechanisms is mounted in a respective one of the slots of the main body, each of the braking mechanisms includes:

a braking member mounted in each of the slots of the main body and having a distal end protruding outward from the opening of each of the slots of the main body and extending into the hollow portion of the main body to urge the periphery of the mounting member;

a threaded block mounted in each of the slots of the main body; and an elastic member mounted in each of the slots of the main body and urged on the braking member and the threaded block.

2. The braking device for an exercising cycle in accordance with claim 1, wherein the slots are equally spaced from each other.

3. The braking device for an exercising cycle in accordance with claim 1, wherein the opening of each of the slots of the main body has an arcuate shape.

4. The braking device for an exercising cycle in accordance with claim 1, wherein each of the slots of the main body has a wall formed with an inner threaded portion, and the threaded block has an outer threaded portion screwed into the inner threaded portion of each of the slots of the main body.

5. The braking device for an exercising cycle in accordance with claim 1, wherein the braking member is a braking rod.

6. The braking device for an exercising cycle in accordance with claim 5, wherein the braking rod has an arcuate portion protruding outward from the opening of each of the slots of the main body and extending into the hollow portion of the main body to urge the periphery of the mounting member.

7. The braking device for an exercising cycle in accordance with claim 5, wherein each of the braking mechanisms further includes an urging plate mounted in each of the slots of the main body and urged between the braking rod and the elastic member.

8. The braking device for an exercising cycle in accordance with claim 1, wherein the braking member is a braking block.

9. The braking device for an exercising cycle in accordance with claim 8, wherein the braking block is mounted in each of the slots of the main body and has an arcuate protruding portion protruding outward from the opening of each of the slots of the main body and extending into the hollow portion of the main body to urge the periphery of the mounting member.

10. The braking device for an exercising cycle in accordance with claim 1, wherein the mounting member has a periphery formed with a plurality of flat sections urged on the braking member of each of the braking mechanisms.

11. The braking device for an exercising cycle in accordance with claim 10, wherein the flat sections of the mounting member are equally spaced from each other.

12. The braking device for an exercising cycle in accordance with claim 10, wherein the periphery of the mounting member is formed with a plurality of corners each located between any two adjacent flat sections and each urged on the braking member of each of the braking mechanisms.

* * * * *

US006745873C1

(12) EX PARTE REEXAMINATION CERTIFICATE (8019th)

United States Patent

Chen

(10) Number: US 6,745,873 C1

(45) Certificate Issued: Feb. 8, 2011

(54) BRAKING DEVICE FOR AN EXERCISING CYCLE

(76) Inventor: Hsi-Yuan Shawn Chen, 58, Ma Yuan West St., Taichung (TW)

Reexamination Request:
No. 90/009,514, Jul. 7, 2009

Reexamination Certificate for:

| | |
|---|---|
| Patent No.: | **6,745,873** |
| Issued: | **Jun. 8, 2004** |
| Appl. No.: | **10/356,761** |
| Filed: | **Jan. 29, 2003** |

(51) Int. Cl.
*A63B 17/02* (2006.01)

(52) U.S. Cl. ..... 188/24.11; 482/114

(58) Field of Classification Search ..... 188/83, 188/82.84

See application file for complete search history.

(56) References Cited

U.S. PATENT DOCUMENTS

| | | | | |
|---|---|---|---|---|
| 651,706 | A | | 6/1900 | Forbes |
| 1,228,673 | A | | 6/1917 | Hribar |
| 3,599,781 | A | | 8/1971 | Hoadley |
| 3,651,906 | A | | 3/1972 | Slator et al. |
| 3,902,575 | A | | 9/1975 | Nelson et al. |
| 3,957,144 | A | | 5/1976 | Opyrchal |
| 4,689,024 | A | | 8/1987 | Ferguson |
| 5,961,424 | A | * | 10/1999 | Warner et al. ..... 482/63 |

OTHER PUBLICATIONS

Edward H. Smith; Mechanical Engineer's Reference Book; Twelfth Edition 1994; 1–/43/10/45; 6 pages.

* cited by examiner

*Primary Examiner*—Matthew C. Graham

(57) ABSTRACT

A braking device for an exercising cycle includes a main body, a mounting member, and a plurality of braking mechanisms. Each of the braking mechanisms includes a braking member, a threaded block, and an elastic member. Thus, the braking device can achieve the braking effect without having to provide the brake pad, thereby saving consumption of material. In addition, the braking effect is provided by the multiple braking rods, so that the applied force can be evenly distributed, thereby increasing the lifetime of the braking device. Further, the threaded block can be rotated to adjust the magnitude of the braking force, thereby achieving the exercising effect efficiently.

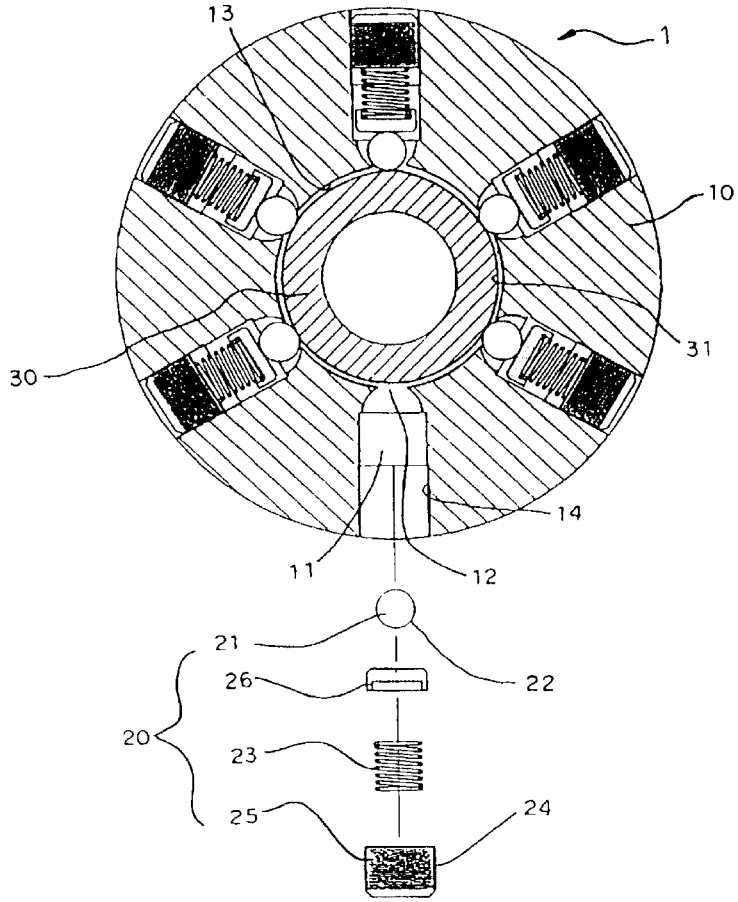

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-12 are cancelled.

* * * * *